US005316890A

United States Patent [19]

Okamura et al.

[11] Patent Number: 5,316,890

[45] Date of Patent: May 31, 1994

[54] SILVER HALIDE PHOTOGRAPHIC MATERIAL

[75] Inventors: Hisashi Okamura; Kazumi Nii; Kazunobu Katoh, all of Kanagawa, Japan

[73] Assignee: Fuji Photo Film Co., Ltd., Kanagawa, Japan

[21] Appl. No.: 83,256

[22] Filed: Jun. 29, 1993

[30] Foreign Application Priority Data

Jun. 29, 1992 [JP] Japan ..... 4-192748
Jul. 2, 1992 [JP] Japan ..... 4-175713

[51] Int. Cl.[5] ..... G03C 1/06
[52] U.S. Cl. ..... 430/264; 430/598
[58] Field of Search ..... 430/264, 598

[56] References Cited

U.S. PATENT DOCUMENTS 4,988,604 1/1991 Machonkin et al. ..... 430/264
4,994,365 2/1991 Looker et al. ..... 430/598
5,190,847 3/1993 Chan et al. ..... 430/264
5,213,944 5/1993 Adin ..... 430/264
5,232,818 8/1993 Machonkin et al. ..... 430/264

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide light-sensitive material containing a compound selected from compounds represented by formula (I) or (II):

(I)

(II)

wherein $L^1$ represents —O—, —S—, —SO—, —$SO_2$—, —$N(R^4)$—, —$CONR^4$—, —$NR^4CO$—, —$OCONR^4$—, —$NR^4CONR^4$—, —$SO_2NR^4$—, —$NR^4SO_2$— or —$NR^4SO_2NR^4$—, each of which is bonded to the pyridine ring at the right hand side thereof; $L^2$, $L^3$, and $L^4$ each represent a divalent aliphatic group or a divalent aromatic group; G represents —CO—, —$SO_2$—, —SO—, —COCO—, a thiocarbonyl group, an iminomethylene group or —$P(O)(G^1R^4)$—; $G^1$ represents a single bond, —O— or —$NR^4$—; $R^1$ represents an aliphatic group or an aromatic group; $R^2$ represents a monovalent substituent; $n^1$ represents 0 or an integer of from 1 to 4; $R^3$ represents a hydrogen atom, an aliphatic group, an aromatic group, an alkoxy group, an aryloxy group or an amino group; $R^4$ represents a hydrogen atom, an aliphatic group or an aromatic group; $R^5$ represents a monovalent group; m represents 0 or an integer of from 1 to 4; $n^2$ represents 0 or an integer of from 1 to 5; and $X^-$ represents a counter anion or a counter anion moiety in an intramolecular salt; two or more $R^2$'s, $R^4$'s or $R^5$'s, if any, may be the same or different.

The light-sensitive material exhibits high processing stability even in rapid processing and provides a high contrast image even when developed with a developing solution at a low pH.

15 Claims, No Drawings

SILVER HALIDE PHOTOGRAPHIC MATERIAL

FIELD OF THE INVENTION

This invention relates to a silver halide photographic material and a method of forming a ultrahigh contrast negative image using the same. More particularly, it relates to a ultrahigh contrast negative silver halide photographic material suitable for use in photomechanical process.

BACKGROUND OF THE INVENTION

In the field of graphic arts, an image formation system providing ultrahigh contrast (especially a gamma exceeding 10) is required for achieving satisfactory reproduction of a dot image having continuous tone or a line image.

Image formation systems of using hydrazine derivatives have been proposed to obtain a high contrast image while using a stable developing solution as disclosed in U.S. Pat. Nos. 4,224,401, 4,168,977, 4,166,742, 4,311,781, 4,272,606, and 4,211,857. According to these systems, ultrahigh contrast and high sensitivity can be obtained. Further, since addition of a sulfite to a developing solution in a high concentration is permissive, stability of the developing solution against air oxidation can be greatly improved over lith developers. Nevertheless, hydrazine compounds which have been proposed to date turned out to have several disadvantages. That is, while it has been attempted to make the structure of hydrazine compounds non-diffusive for the purpose of minimizing adverse influences which may arise from the hydrazine compounds dissolved in a developing solution. These non-diffusive hydrazine compounds should be used in large quantities for sufficient sensitization and improvement in contrast so that they are apt to cause deterioration of physical properties of the developed light-sensitive layers or to precipitate in a coating composition. Further, when a light-sensitive material containing such a non-diffusive hydrazine compound fails to obtain sufficient high contrast when developed with a fatigued developing solution after use for processing a large volume of photographic materials.

In addition, a high contract system using the conventional hydrazine compound involves use of a developing solution having a relatively high pH, e.g., 11.5 or 11.8, which entails not only danger on handling but cost for waste liquid treatment due to high BOD or COD. Because a large amount of a pH buffer must be added to a developing solution for maintaining the pH constant, the developing solution is sticky due to the so increased solid content and is hardly wiped away when scattered.

It has therefore been demanded to develop a hydrazine compound which can achieve high contrast image formation while using a developing solution having a lower pH than in the systems using a conventional hydrazine derivative (U.S. Pat. No. 4,994,365).

On the other hand, light-sensitive materials for dot-to-dot work which are generally handled in a bright room occupy a large proportion in the field of photomechanical processing. In this field, high reproducibility in formation of super-imposed letters even with a fine line width is demanded. To meet the demand, development of a nucleating agent having improved activity has been long awaited. The expectation for a nucleating agent with higher activity is particularly high for use in light-sensitive materials having low sensitivity so as to be handled in a bright room because they hardly undergo the activity of a nucleating agent.

SUMMARY OF THE INVENTION

An object of the present invention is to provide a silver halide photographic material for photomechanical processing which exhibits excellent stability in development processing and can be rapidly processed.

Another object of the present invention is to provide a silver halide photographic material for photomechanical processing which can be developed at a reduced pH.

The above objects of the present invention are accomplished by a silver halide light-sensitive material containing a compound selected from those represented by formulae (I) and (II):

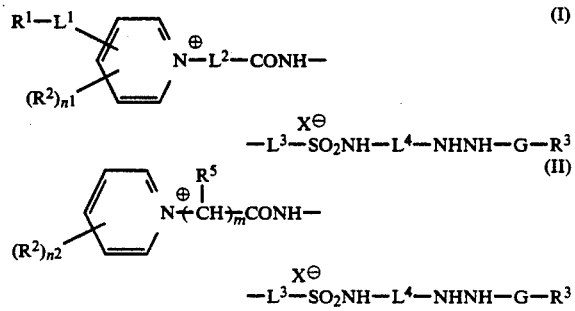

(I)

(II)

wherein $L^1$ represents —O—, —S—, —SO—, —$SO_2$—, —N($R^4$)—, —CONR$^4$—, —NR$^4$CO—, —OCONR$^4$—, —NR$^4$CONR$^4$—, —$SO_2$NR$^4$—, —NR$^4$$SO_2$— or —NR$^4$$SO_2$NR$^4$—, each of which is bonded to the pyridine ring at the right hand side thereof; $L^2$, $L^3$, and $L^4$ each represent a divalent aliphatic group or a divalent aromatic group; G represents —CO—, —$SO_2$—, —SO—, —COCO—, a thiocarbonyl group, an iminomethylene group or —P(O)(G$^1$R$^4$)—; G$^1$ represents a single bond, —O— or —NR$^4$—; $R^1$ represents an aliphatic group or an aromatic group; $R^2$ represents a monovalent substituent; $n^1$ represents 0 or an integer of from 1 to 4; $R^3$ represents a hydrogen atom, an aliphatic group, an aromatic group, an alkoxy group, an aryloxy group or an amino group; $R^4$ represents a hydrogen atom, an aliphatic group or an aromatic group; $R^5$ represents a monovalent group; m represents 0 or an integer of from 1 to 4; $n^2$ represents 0 or an integer of from 1 to 5; and $X^-$ represents a counter anion or a counter anion moiety in an intramolecular salt; two or more $R^2$'s, $R^4$'s or $R^5$'s, if any, may be the same or different.

DETAILED DESCRIPTION OF THE INVENTION

In formulae (I) and (II), substituents $L^3$, $L^4$, G, $R^2$, $R^3$ and $X^-$ have common definitions.

In formula (I), the aliphatic group as represented by $R^1$ preferably includes those having from 1 to 30 carbon atoms, and particularly a straight chain, branched or cyclic alkyl group having from 1 to 20 carbon atoms.

The aromatic group as represented by $R^1$ includes a monocyclic or bicyclic aryl group or an unsaturated heterocyclic group which may be condensed with an aryl group.

The aliphatic group or aromatic group as $R^1$ may be substituted. Typical substituents on $R^1$ include the groups described below as examples of $R^2$.

$R^2$ represents a monovalent substituent. Examples of preferred groups for $R^2$ include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl or arylthio group, an alkyl or arylsulfonyl group, an alkyl or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group, etc. Preferred of these groups are an alkyl group (preferably having 1 to 20 carbon atoms), an aralkyl group (preferably having 7 to 30 carbon atoms), an alkoxy group (preferably having 1 to 20 carbon atoms), a substituted amino group (preferably an amino group substituted with an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), and a phosphoric acid amido group (preferably having 1 to 30 carbon atoms). These substituents may further be substituted.

$n^1$ and $n^2$ are preferably 0.

The aliphatic group as represented by $R^3$ preferably includes an alkyl group having from 1 to 4 carbon atoms. The aromatic group as represented by $R^3$ preferably includes a monocyclic or bicyclic aryl group (e.g., a benzene ring-containing group).

Where G is —CO—, $R^3$ preferably represents a hydrogen atom, an alkyl group (e.g., methyl, trifluoromethyl, 3-hydroxypropyl, 3-methanesulfonamidopropyl or phenylsulfonylmethyl), an aralkyl group (e.g., o-hydroxybenzyl), an aryl group (e.g., phenyl, 3,5-dichlorophenyl, o-methanesulfonamidophenyl, 4-methanesulfonylphenyl or 2-hydroxymethylphenyl), etc., with a hydrogen atom being particularly preferred.

$R^3$ may be substituted with, for example, the substituents mentioned above as examples of $R^2$.

G is most preferably —CO—.

$R^3$ may be a group which makes the G-$R^3$ moiety be split off the rest of the compound and induces a cyclization reaction to form a cyclic structure including the —G—$R^3$ moiety Specific examples of such a group are described, e.g., in JP-A-63-29751 (the term "JP-A" as used herein means an "unexamined published Japanese patent application").

$R^4$ preferably represents a hydrogen atom or an alkyl group having from 1 to 6 carbon atoms, and most preferably a hydrogen atom. When there are two or more $R^2$'s, $R^4$'s or $R^5$'s per molecule, they may be the same or different.

A divalent bonding group of $L^1$ in formula (I) preferably represents —O—, —S—, —N($R^4$)—, —CONR$^4$—, —OCONR$^4$— or $SO_2NR^4$—.

The divalent aliphatic group as represented by $L^2$ in formula (I) and $L^3$ or $L^4$ in formulae (I) and (II) preferably includes those having from 1 to 30 carbon atoms, and particularly a straight chain, branched or cyclic alkylene group having from 1 to 20 carbon atoms.

The divalent aromatic group as represented by $L^2$, $L^3$ or $L^4$ preferably includes a monocyclic or bicyclic aryl group or an unsaturated heterocyclic group which may be condensed with an aryl group.

The aliphatic or aromatic group as $L^2$, $L^3$ or $L^4$ may be substituted typically with the groups specifically enumerated above as examples of $R^2$.

$L^2$ in formula (I) preferably represents an alkylene group, more preferably a group represented by —$(CH_2)_m$—, wherein m is an integer of 1 to 4, and most preferably a methylene group.

$L^3$ and $L^4$ each preferably represent an arylene group, and particularly a benzene ring-containing group. $L^3$ is most preferably a substituted or unsubstituted phenylene group, and $L^4$ is most preferably a p-phenylene group.

$R^5$ in formula (II) represents a monovalent substituent. Examples of preferred groups for $R^2$ include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl or arylthio group, an alkyl or arylsulfonyl group, an alkyl or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, an imido group, etc. Preferred of these groups are an alkyl group (preferably having 1 to 20 carbon atoms), an aralkyl group (preferably having 7 to 30 carbon atoms), an alkoxy group (preferably having 1 to 20 carbon atoms), a substituted amino group (preferably an amino group substituted with an alkyl group having 1 to 20 carbon atoms), an acylamino group (preferably having 2 to 30 carbon atoms), a sulfonamido group (preferably having 1 to 30 carbon atoms), a ureido group (preferably having 1 to 30 carbon atoms), and a phosphoric acid amido group (preferably having 1 to 30 carbon atoms). These substituents may further be substituted.

The anion represented by $X^-$ is a counter anion of the pyridinium moiety. Specific examples of $X^-$ are halide ions, a sulfonate ion, a sulfate ion, a phosphonate ion, a phosphate ion, $BF_4^-$, $ClO_4^-$, and $PF_6^-$, with $Cl^-$, $BF_4^-$, $PF_6^-$, and a sulfonate ion being preferred. $X^-$ may be bonded to any of $R^1$, $R^2$, $R^3$, $R^5$, $L^1$, $L^2$, $L^3$, and $L^4$ to form an intramolecular salt.

$R^1$, $R^2$, $R^3$, $R^5$, $L^2$, $L^3$ or $L^4$ may contain therein a ballast group or a polymer which are generally employed in immobile photographically useful additives, such as couplers. The ballast group is an organic group which contains at least 8 carbon atoms and is relatively insert to photographic properties. Usable ballast groups include an alkyl group, an alkoxy group, a phenyl group, an alkylphenyl group, an phenoxy group, and an alkylphenoxy group. The polymer which may be incorporated includes those described in JP-A-1-100530.

$R^1$, $R^2$, $R^3$, $R^5$, $L^2$, $L^3$ or $L^4$ may further contain therein a group which accelerates adsorption onto silver halide grains. Suitable adsorption accelerating groups include a thiourea group, a heterocyclic thioamido group, a heterocyclic mercapto group, a triazole group. Specific examples of these groups are described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-62-948, JP-A-63-234244, JP-A-63-234245, and JP-A-63-234246.

Specific examples of the hydrazine compounds (I) and (II) which can be used in the present invention are shown below for illustrative purposes only but not for limitation.

Compound 1:
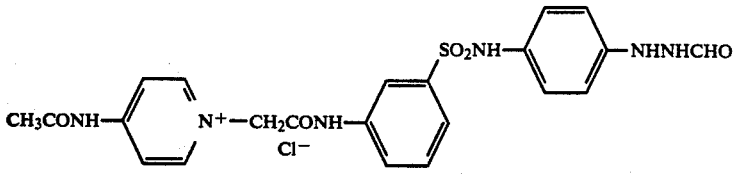
Compound 2:
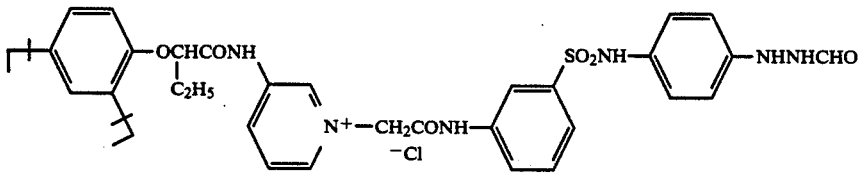
Compound 3:
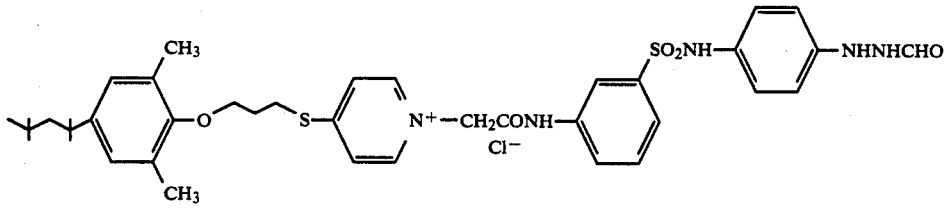
Compound 4:
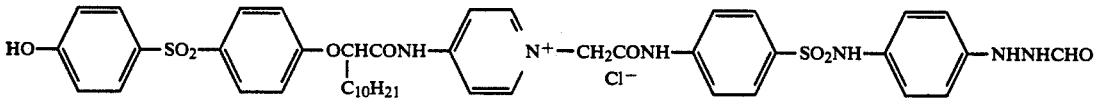
Compound 5:
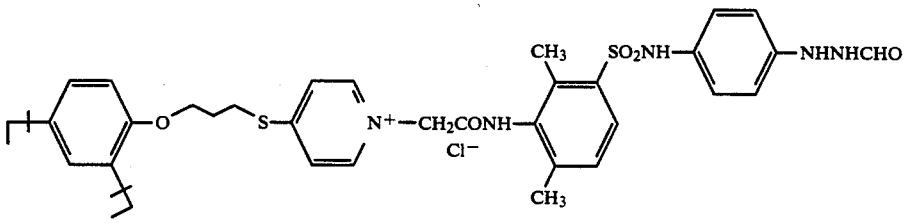
Compound 6:
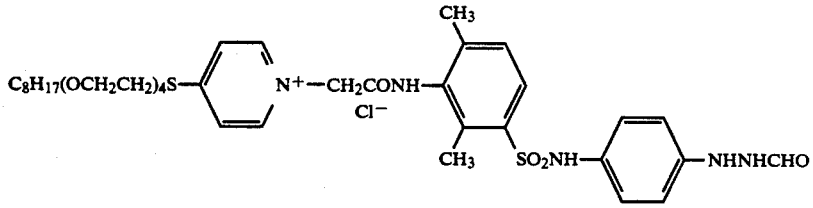
Compound 7:
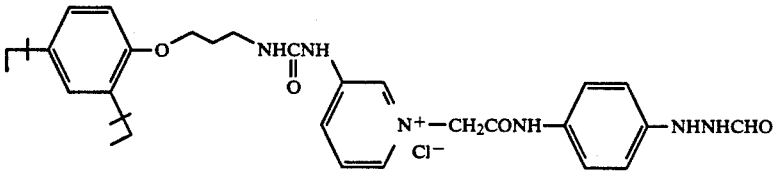
Compound 8:

-continued
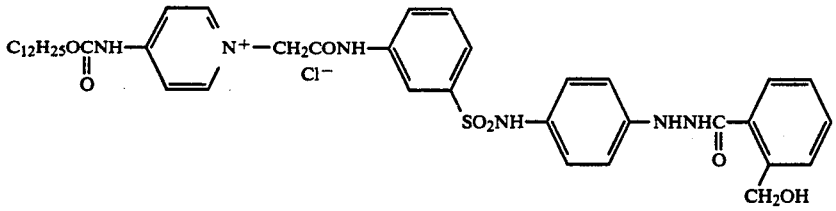
Compound 9:
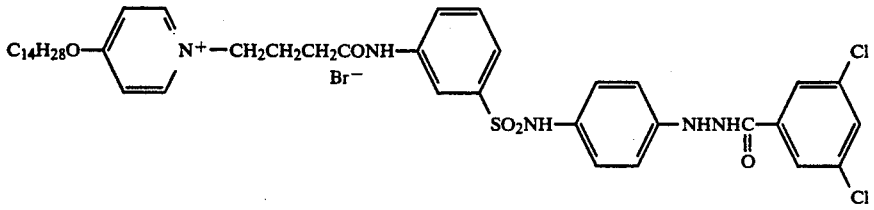
Compound 10:
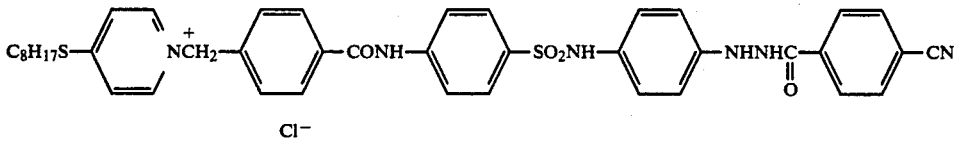
Compound 11:
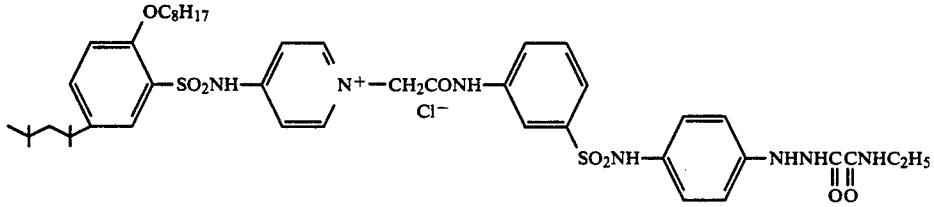
Compound 12:
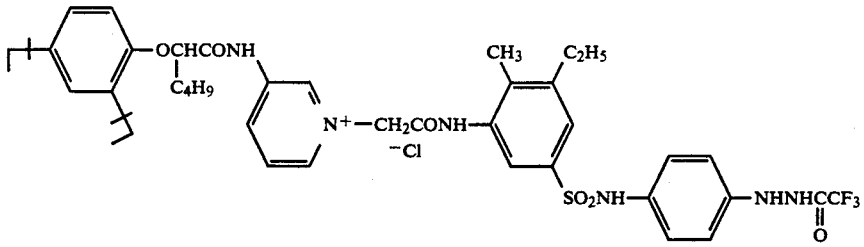
Compound 13:
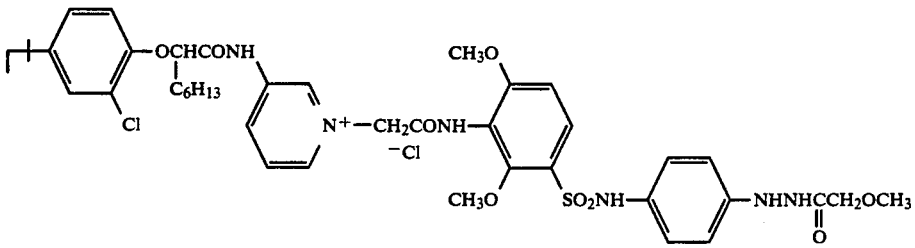
Compound 14:

-continued
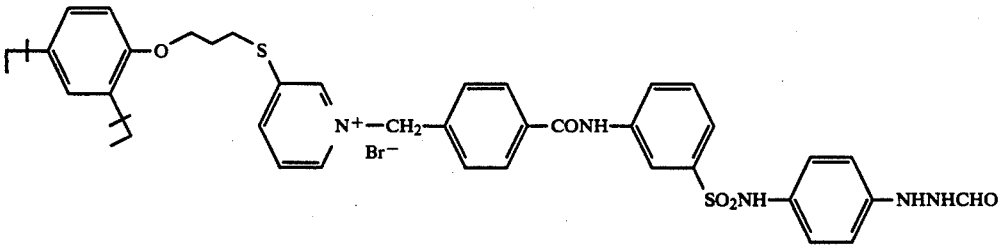
Compound 15:
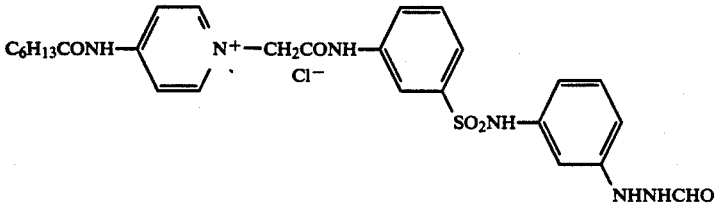
Compound 16:
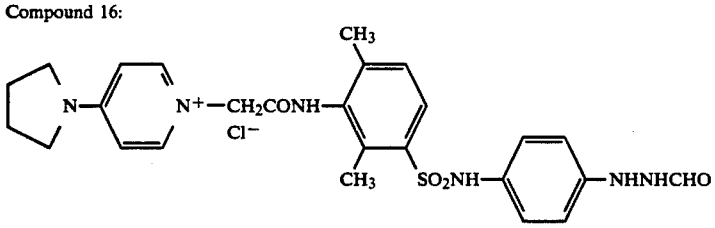
Compound 17:
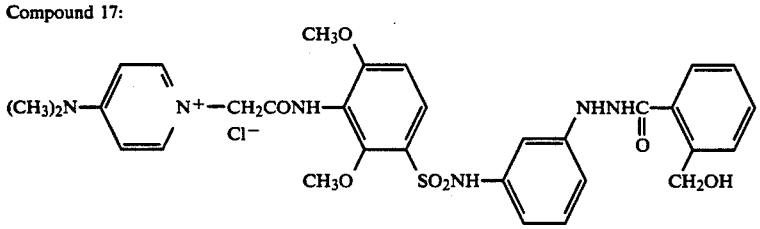
Compound 18:
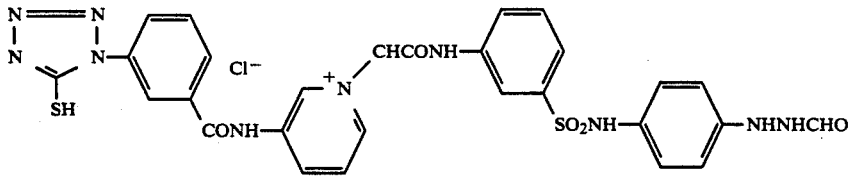
Compound 19:
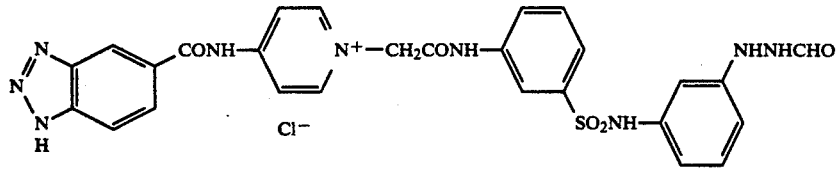
Compound 20:
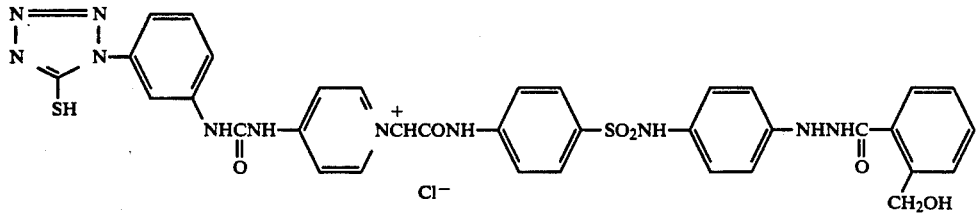

-continued
Compound 21:
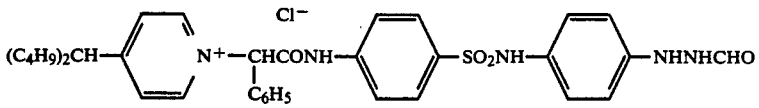
Compound 22:
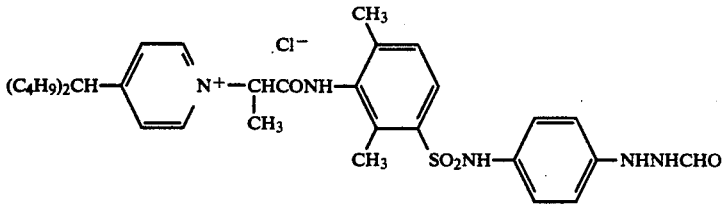
Compound 23:
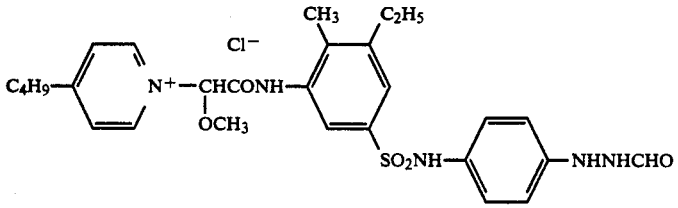
Compound 24:
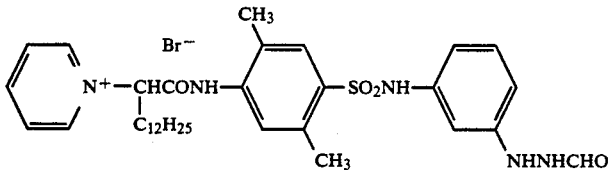
Compound 25:
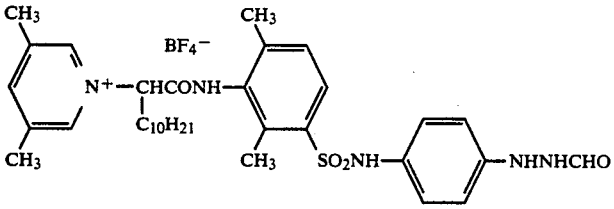
Compound 26:
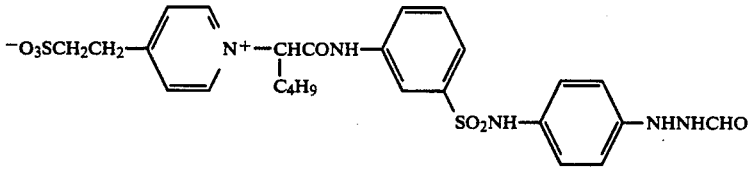
Compound 27:
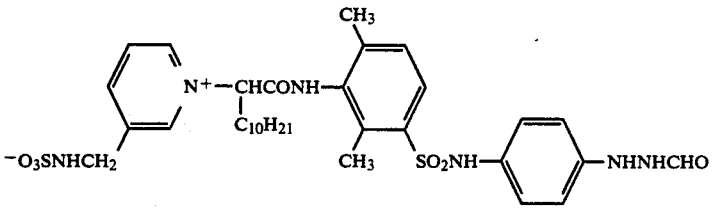
Compound 28:

-continued
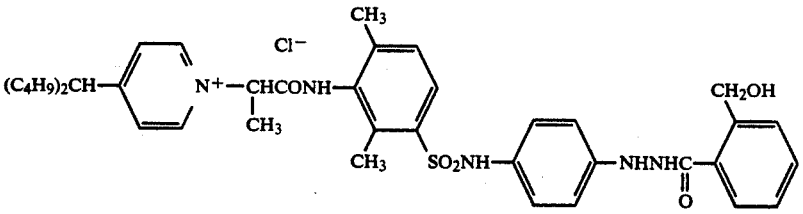
Compound 29:
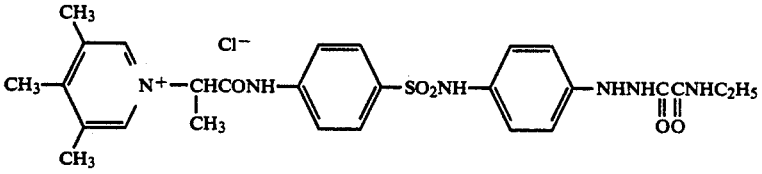
Compound 30:
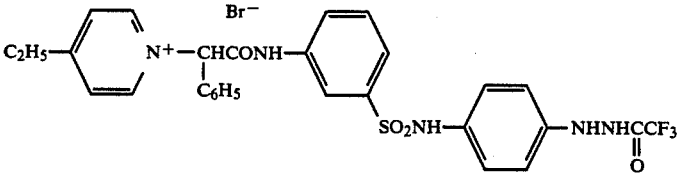
Compound 31:
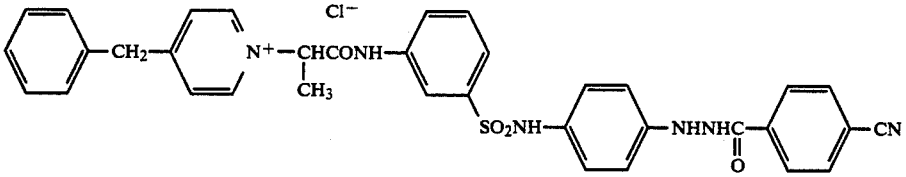
Compound 32:
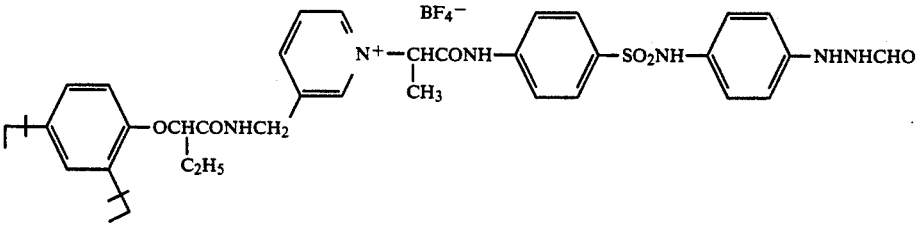
Compound 33:
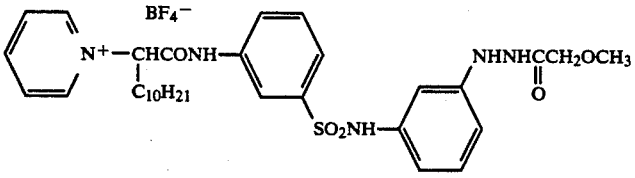
Compound 34:
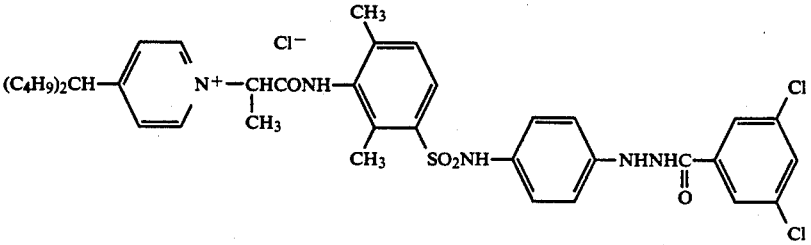
Compound 35:

-continued

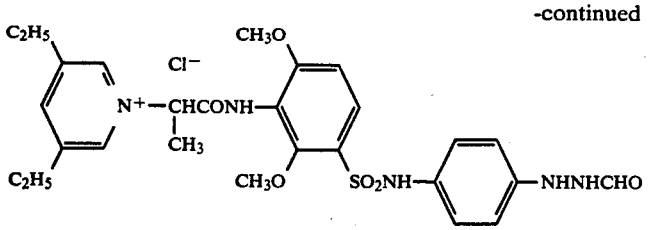

Compound 36:

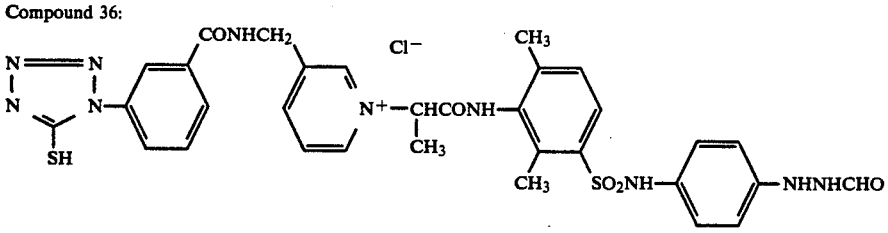

Compound 37:

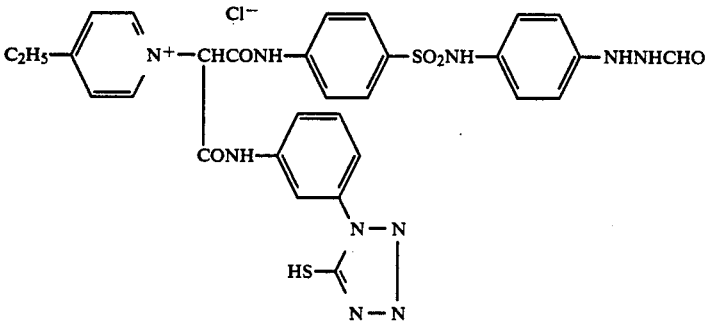

Compound 38:

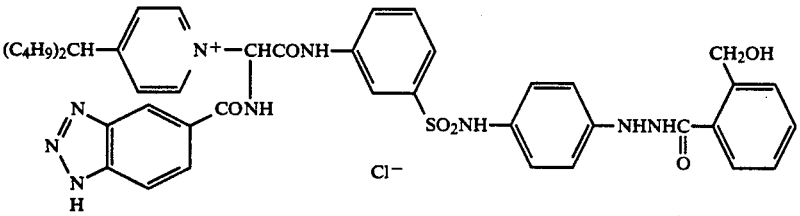

The hydrazine compound according to the present invention can be synthesized by utilizing the processes disclosed, e.g., in JP-A-61-213847, JP-A-62-260153, U.S. Pat. No. 4,684,604, JP-A-1-269936, U.S. Pat. Nos. 3,379,529, 3,620,746, 4,377,634, and 4,332,878, JP-A-49-129536, JP-A-56-153336, JP-A-56-153342, and U.S. Pat. Nos. 4,988,604 and 4,994,365.

The hydrazine compound (I) or (II) is used as dissolved in an appropriate water-miscible organic solvent, such as an alcohol (e.g., methyl alcohol, ethyl alcohol, propyl alcohol or a fluorinated alcohol), a ketone (e.g., acetone or methyl ethyl ketone), dimethylformamide, dimethyl sulfoxide, methyl cellosolve, etc.

The hydrazine compound (I) or (II) may also be used in the form of an emulsified dispersion prepared by a well-known dispersion method using an oil (e.g., dibutyl phthalate, tricresyl phosphate, glyceryl triacetate or diethyl phthalate) and an auxiliary solvent (e.g., ethyl acetate or cyclohexanone) followed by mechanical dispersion. It is also possible to use the hydrazine compound (I) as a dispersion prepared by a well-known solid' dispersion method in which a powdered compound is dispersed in water in a ball mill, a colloid mill, etc. or by ultrasonic waves.

The hydrazine compound (I) or (II) is preferably used in an amount ranging from $1.0\times10^{-6}$ to $5\times10^{-2}$ mol, and preferably from $1.0\times10^{-5}$ to $2\times10^{-2}$ mol, per mole of a silver halide.

The hydrazine compound (I) or (II) is preferably incorporated into a silver halide emulsion layer but may be incorporated into other light-insensitive hydrophilic colloidal layers, such as a protective layer, an intermediate layer, a filter layer, an antihalation layer, and the like. Where it is added to a silver halide emulsion layer, the addition may be effected at any arbitrary stage of from the start of chemical ripening and before coating. The compound is preferably added after completion of chemical ripening and before coating, and more preferably added to a coating composition to be coated.

The silver halide emulsion which can be used in the present invention may have any halogen composition, such as silver chloride, silver chlorobromide, silver iodobromide, and silver iodochlorobromide. In the case of light-sensitive materials for dot-to-dot work, silver halide grains comprising at least 60 mol %, and particularly 75 ml % or more, of silver chloride are preferred. In the case of light-sensitive materials for halftoning work, silver halide grains comprising at least 70 mol %, and particularly 90 mol % or more, of silver bromide with a silver iodide content being not more than 10 mol %, and particularly from 0.1 to 5 mol %, are preferred.

Fine silver halide grains (e.g., having a mean grain size of 0.7 μm or less) are preferred in the present invention. A particularly preferred mean grain size is 0.5 μm or less. Grain size distribution is not essentially limited, but a mono-dispersion is preferred. The terminology "mono-dispersion" as used herein means a dispersion in which at least 95% of the weight or number of grains fall within a size range of ±40% of a mean grain size.

Silver halide grains in a photographic emulsion may have a regular crystal form, such as a cubic form and an octahedral form, or an irregular crystal form, such as a spherical form and a plate-like form, or a composite form of these crystal forms. Cubic grains are particularly preferred.

Individual silver halide grains may have a uniform phase or different phases between the inside and the surface layer thereof. Two or more different silver halide emulsions separately prepared may be used as a mixture.

During silver halide grain formation or physical ripening of grains, a cadmium salt, a sulfite salt, a lead salt, a thallium salt, a rhodium salt or a complex thereof, an iridium salt or a complex thereof, etc. may be present in the system. Suitable rhodium salts include rhodium monochloride, rhodium dichloride, rhodium trichloride, ammonium hexachlororhodate and, for preference, water-soluble halogeno-complex compounds of trivalent rhodium, e.g., hexachlororhodic (III) acid or salts thereof (e.g., ammonium salt, sodium salt or potassium salt). The water-soluble rhodium salt is usually added in an amount of from $1.0\times10^{-8}$ to $1.0\times10^{-3}$ mol, and preferably from $1.0\times10^{-7}$ to $5.0\times10^{-4}$ mol, per mol of silver halide.

The silver halide emulsion which can be used in the present invention may or may not be chemically sensitized. Chemical sensitization of a silver halide emulsion is carried out by sulfur sensitization, reduction sensitization, noble metal sensitization, or combination thereof.

Among the noble metal sensitization techniques, typical is gold sensitization using a gold compound, usually a gold complex. Complexes of noble metals other than gold, e.g., platinum, palladium and iridium, may also be employed. Specific examples of these noble metal compounds are described in U.S. Pat. No. 2,448,060 and British Patent 618,016.

Sulfur sensitization is effected by using a sulfur compound contained in gelatin as well as various sulfur compounds, e.g., thiosulfates, thioureas, thiazoles, and rhodanines.

Reduction sensitization is carried out by using a reducing compound, e.g., stannous salts, amines, formamidinesulfinic acid, and silane compounds.

The silver halide emulsion layers may further contain known spectral sensitizing dyes. Useful sensitizing dyes, combination of dyes exhibiting supersensitization, and substances showing supersensitization are disclosed in *Research Disclosure*, Vol. 176, No. 17643, p. 23, IV-J (Dec., 1978).

Binders or protective colloids which can be used in the silver halide emulsions include gelatin to advantage. Hydrophilic colloids other than gelatin may also be employable, including proteins, e.g., gelatin derivatives, graft polymers of gelatin and other high polymers, albumin, and casein; cellulose derivatives, e.g., hydroxyethyl cellulose, carboxymethyl cellulose, and cellulose sulfate esters; sugar derivatives, e.g., sodium alginate and starch derivatives; and a variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole, as well as copolymers comprising monomers constituting these homopolymers.

Gelatin to be used includes lime-processed gelatin, acid-processed gelatin, hydrolysis products of gelatin, and enzymatic decomposition products of gelatin.

For prevention of fog during preparation, preservation or photographic processing of the light-sensitive material or for stabilization of photographic properties, various compounds can be introduced into the light-sensitive material of the present invention. Such compounds include azoles, such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, and nitrobenzotriazoles; mercaptopyrimidines; mercaptotriazines; thioketo compounds, such as oxazolinethione; azaindenes, such as triazaindenes, tetraazaindenes (especially 4-hydroxy-substituted (1,3,3a,7)-tetraazaindenes), and pentaazaindenes; hydroquinone and derivatives thereof; disulfides, such as thioctic acid; benzenethiosulfonic acids, benzenesulfinic acids, benzenesulfonic acid amides, and many other compounds known as antifoggants or stabilizers. Preferred of them are benzotriazoles (e.g., 5-methylbenzotriazole) and nitroindazoles (e.g., 5-nitroindazole). If desired, these compounds may be added to a processing solution.

The light-sensitive materials of the present invention may contain an organic desensitizer containing at least one water-soluble or alkali-dissociating group. Suitable organic desensitizers are illustrated in JP-A-63-64039. The organic desensitizer is usually added to a silver halide emulsion layer in an amount of from $1.0\times10^{-8}$ to $1.0\times10^{-4}$ mol/m$^2$, and preferably of from $1.0\times10^{-7}$ to $1.0\times10^{-5}$ mol/m$^2$.

The light-sensitive materials of the present invention may contain a development accelerator or a nucleation infectious development accelerator. Examples of effective development accelerators or nucleation infectious development accelerators are disclosed in JP-A-53-77616, JP-A-54-37732, JP-A-53-137133, JP-A-60-140340, and JP-A-60-14959 as well as various compounds containing a nitrogen or sulfur atom.

Specific examples of these development accelerators are shown below.

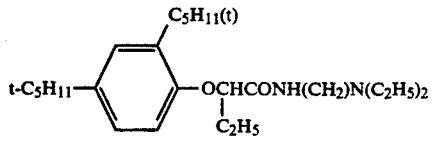

(1)

-continued (2)

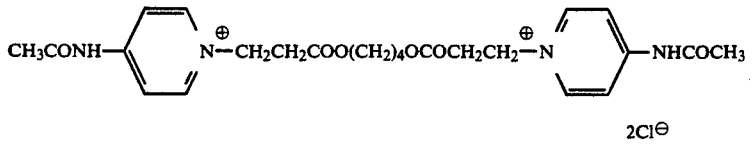

(3)

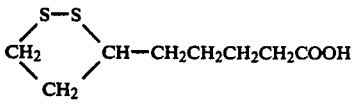

(4)

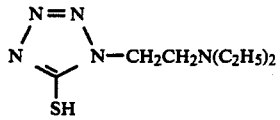

(5)

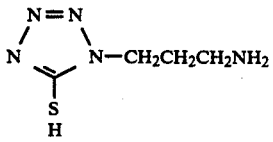

(6)

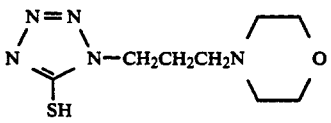

(7)

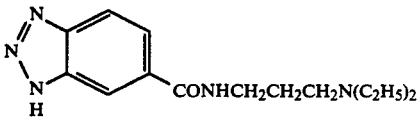

(8)

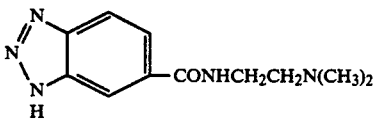

(9)

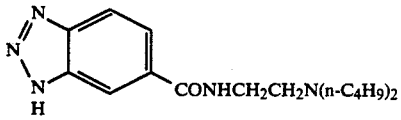

(10)

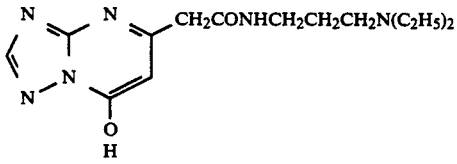

(11)

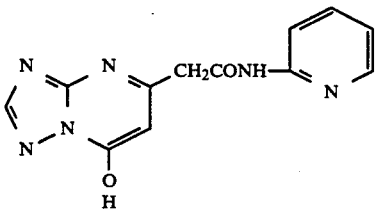

(12)

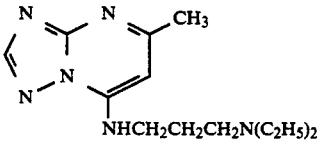

(13)

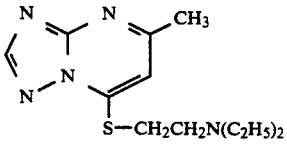

(14)

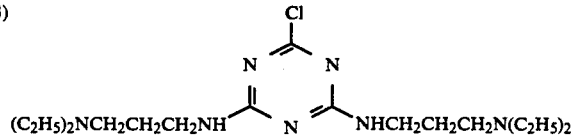

$(C_2H_5)_2NCH_2CH(OH)-CH_2OH$ (15)

$n\text{-}C_4H_9N(C_2H_4OH)_2$ (16)

(17)

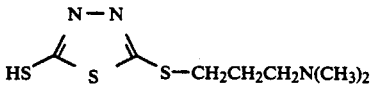

The development accelerator is used in an amount usually of from $1.0\times10^{-3}$ to 0.5 g/m$^2$, and preferably from $5.0\times10^{-3}$ to 0.1 g/m$^2$, although the optimum amount varies depending on the kind of the compound. The development accelerator can be incorporated into a coating composition as dissolved in an appropriate solvent, e.g., water, alcohols (e.g., methyl alcohol and ethyl alcohol), acetone, dimethylformamide, and methyl cellosolve.

The above-mentioned additives may be used either individually or in combination of two or more thereof.

The emulsion layers or other hydrophilic colloidal layers of the light-sensitive material according to the present invention may contain a water-soluble dye as a filter dye or an anti-irradiation dye or for various other purposes. Filter dyes to be used include those for reducing photographic sensitivity, preferably ultraviolet absorbents having a spectral absorption maximum in the intrinsic sensitivity region of silver halide and those for improving safety against safelight in handling of light-sensitive materials for bright room, i.e., dyes showing substantial light absorption in the region chiefly in the range of from 310 to 600 nm.

According to the purpose, these dyes are preferably added to an emulsion layer or fixed in a light-insensitive hydrophilic colloidal layer farther from a support than a silver halide emulsion layer by using a mordant. The dyes are added in an amount usually of from $1\times10^{-3}$ to 1 g/m$^2$, and preferably of from 10 to 500 mg/m$^2$, though varying depending on the molar absorption coefficient of the dye.

The above-mentioned dyes are added to a coating composition for a light-sensitive and/or light-insensitive hydrophilic colloidal layer in the form of a solution in an appropriate solvent, e.g., water, an alcohol (e.g., methyl alcohol, ethyl alcohol, or propyl alcohol), acetone, methyl cellosolve or a mixture thereof.

These dyes may be used either individually or in combination of two or more thereof.

Specific examples of suitable dyes are described in JP-A-63-64039.

In addition, ultraviolet absorbing dyes described in U.S. Pat. Nos. 3,533,794, 3,314,794, and 3,352,681, JP-A-46-2784, U.S. Pat. No. 3,705,805, 3,707,375, 4,045,229, 3,700,455, and 3,499,762, and West German Patent Publication 1,547,863, pyrazolone oxonol dyes described in U.S. Pat. No. 2,274,782, diaryl azo dyes described in U.S. Pat. No. 2,956,879, styryl dyes or butadienyl dyes described in U.S. Pat. Nos. 3,423,207 and 3,384,487, merocyanine dyes described in U.S. Pat. No. 2,527,583, merocyanine dyes or oxonol dyes described in U.S. Pat. Nos. 3,486,897, 3,652,284, and 3,718,472, enaminohemioxonol dyes described in U.S. Pat. No. 3,976,661, and other dyes described in British Patents 584,609 and 1,177,429, JP-A-48-85130, JP-A-49-99620, JP-A49-114420, and U.S. Pat. No. 2,533,472, 3,148,187, 3,177,078, 3,247,127, 3,540,887, 3,575,704, and 3,653,905 may also be employed.

The silver halide emulsion layers or other hydrophilic colloidal layers may contain an organic or inorganic hardening agent, such as chromates (e.g., chromium alum and chromium acetate), aldehydes (e.g., formaldehyde, glyoxal, and glutaraldehyde), N-methylol compounds (e.g., dimethylolurea and methyloldimethylhydantoin), dioxane derivatives (e.g., 2,3-dihydroxydioxane), active vinyl compounds (e.g., 1,3,5-triacryloylhexahydro-s-triazine and 1,3-vinylsulfonyl-2-propanol), active halogen compounds (e.g., 2,4-dichloro-6-hydroxy-striazine), and mucohalogenic acids (e.g., mucochloric acid and mucophenoxychloric acid), epoxy compounds (e.g., tetramethylene glycol diglycidyl ether), and isocyanate compounds (e.g., hexamethylene diisocyanate), either individually or in combination thereof.

High polymeric hardening agents described in JP-A-56-66841, British Patent 1,322,971, and U.S. Pat. No. 3,671,256 can also be used.

The silver halide emulsion layers or other hydrophilic colloidal layers may further contain various surface active agents for the purpose of coating aid, static charge prevention, improvement of slip properties, emulsification and dispersion aid, prevention of blocking, and improvement of photographic characteristics (e.g., acceleration of development, increase of contrast, and increase of sensitivity).

Useful surface active agents include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone), glycidol derivatives (e.g., alkenylsuccinic acid polyglycerides, and alkylphenol polyglycerides), fatty acid esters of polyhydric alcohols, and alkyl esters of saccharides; anionic surface active agents containing an acid radical, e.g., a carboxyl group, a sulfo group, a phospho group, a sulfuric ester group, and a phosphoric ester group, such as alkylcarboxylates, alkylsulfonates, alkylbenzenesulfonates, alkylnaphthalenesulfonates, alkylsulfates, alkyl phosphates, N-acyl-N-alkyltaurines, sulfosuccinic esters, sulfoalkyl polyoxyethylene alkylphenyl ethers, and polyoxyethylene alkylphosphates; amphoteric surface active agents, such as amino acids, aminoalkylsulfonic acids, aminoalkylsulfates or phosphates, alkylbetaines and amine oxides; and cationic surface active agents, such as alkylamines, aliphatic or aromatic quaternary ammonium salts, heterocyclic quaternary ammonium salts, e.g., pyridinium salts, and imidazolium salts, and phosphonium or sulfonium salts containing an aliphatic or heterocyclic ring.

Surface active agents which are particularly useful in the present invention are polyalkylene oxides having a molecular weight of 600 or more as disclosed in JP-B-58-9412 (the term "JP-B" as used herein means an "examined published Japanese patent application"). For purpose of improving dimensional stability, polymer latices, such as polyalkyl acrylates, may be used.

The silver halide light-sensitive material of the present invention can be processed with a stable developing solution to obtain ultrahigh contrast characteristics. There is no need to use conventional infectious developers or highly alkaline developers having a pH of nearly 13 as described in U.S. Pat. No. 2,419,975.

More specifically, a negative image having sufficiently high contrast can be obtained by processing the silver halide light-sensitive material of the present invention with a developing solution containing 0.15 mol/l or more of a sulfite ion as a preservative and having a pH between 10.5 and 12.3, particularly between 11.0 and 12.0.

A developing agent which can be used in the developing solution is not particularly restricted. For example, dihydroxybenzenes (e.g., hydroquinone), 3-pyrazolidones (e.g., 1-phenyl-3-pyrazolidone and 4,4-dimethyl-1-phenyl-3-pyrazolidone), and aminophenols (e.g., N-methyl-p-aminophenol) are used either alone or in combinations thereof.

A combination of a dihydroxybenzene as a main developing agent and a 3-pyrazolidone or an aminophenol as an auxiliary developing agent is particularly suitable for development of the light-sensitive material of the present invention. In this type of a developing solution, the dihydroxybenzene is preferably used in an amount of from 0.05 to 0.5 mol/l, and the 3-pyrazolidone or aminophenol is preferably used in an amount of not more than 0.06 mol/l.

Addition of an amine compound to a developing solution is effective to increase the rate of development thereby to shorten the time of development as suggested in U.S. Pat. No. 4,269,929.

The developing solution may further contain a pH buffering agent (e.g., the compounds described in JP-A-60-93433 and JP-A-62-186259, e.g., a sulfite, a carbonate, a borate or a phosphate of an alkali metal), a development restrainer (e.g., a bromide and an iodide), and an organic antifoggant (nitroindazoles or benzotriazoles are particularly preferred). If desired, the developing solution may furthermore contain a water softener, a dissolution aid (e.g., the compounds disclosed in JP-A-

61-267759), a toning agents, a development accelerator, a surface active agent (the above-described polyalkylene oxides are particularly preferred), a defoaming agent, a hardening agent, a silver stain inhibitor (e.g., the compounds disclosed in JP-A-56-24347, e.g., 2-mercaptobenzimidazolesulfonic acids), and so on.

A fixing solution which can be used for processing may have any known composition. Usable fixing agents include thiosulfates, thiocyanates, and organic sulfur compounds known to be effective as a fixing agent. The fixing solution may contain a water-soluble aluminum salt, etc. as a hardening agent.

The processing temperature usually ranges from 18° to 50° C.

Photographic processing of the light-sensitive material of the present invention is desirably carried out by means of an automatic developing machine. The light-sensitive material according to the present invention provides a negative image having sufficiently high contrast even when rapidly processed in an overall processing time (the time of from entering an automatic developing machine through withdrawal) of from 90 seconds to 120 seconds.

The present invention is now illustrated in greater detail by way of Examples, but it should be understood that the present invention is not deemed to be limited thereto. All the percents, parts, and ratios are by weight unless otherwise indicated.

EXAMPLE 1

1) Preparation of Light-Sensitive Emulsion

A silver nitrate aqueous solution and a sodium chloride aqueous solution were simultaneously added to a gelatin aqueous solution kept at 40° C. in the presence of $5.0\times10^4$ mol of $NH_4RhCl_6$ per mol of silver. After soluble salts were removed by a well-known method, gelatin was added to the emulsion. To the primitive emulsion was added 2-methyl-4-hydroxy-1,3,3a,7-tetraazaindene as a stabilizer to obtain a mono-dispersed emulsion of cubic grains having a mean grain size of 0.08 μm.

To the thus prepared emulsion was added each of the hydrazine compounds (I) and comparative hydrazine compounds shown in Table 1 below in the amount shown. To the emulsion were further added a polyethyl acrylate latex in an amount of 30% (solid basis) based on gelatin and 1,3-divinylsulfonyl-2-propanol as a hardening agent to prepare a coating composition for a light-sensitive emulsion layer.

2) Preparation of Sample

The above prepared coating composition was coated on a polyester film to a silver coverage of 3.8 g/m² (gelatin coverage: 1.8 g/m²) to form a silver halide emulsion layer.

A coating composition having the following composition was prepared.

| | |
|---|---|
| Gelatin | 0.8 g/m² |
| Nucleation accelerator of formula: | |
| 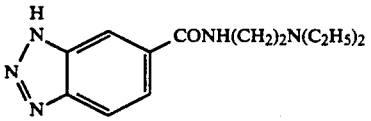 | 8 mg/m² |
| Fine dispersion of dye A of formula: | |

-continued

| | |
|---|---|
| 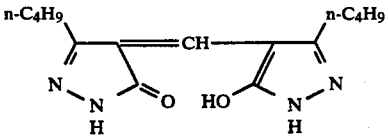 | 30 mg/m² |
| (average particle size: 0.37 μm) | |

To the composition was added 1,3-divinylsulfonyl-2-propanol as a hardening agent. The resulting coating composition was coated on the silver halide emulsion layer to form a gelatin intermediate layer.

A coating composition having the following formulation was further coated thereon to form a protective layer.

| | |
|---|---|
| Gelatin | 0.7 g/m² |
| Polymethyl methacrylate particles (average particle size: 2.5 μm) (matting agent) | 0.3 g/m² |
| Fine dispersion of dye B of formula: | |
| 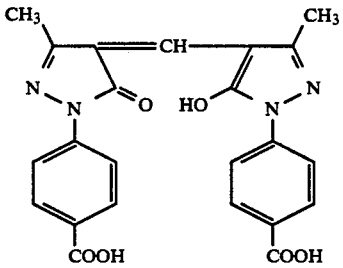 | 60 mg/m² |
| (average particle size: 0.40 μm) | |
| Surface active agents: | |
| 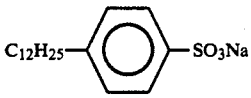 | 37 mg/m² |
| $CH_2COOC_6H_{13}$ / $CHCOOC_6H_{13}$ / $SO_3Na$ | 37 mg/m² |
| $C_8H_{17}SO_2NCH_2COOK$ / $C_3H_7$ | 2.5 mg/m² |

The total amount of the hardening agents was 2.0% based on the total gelatin.

3) Processing

The resulting sample was exposed to light through the original shown in FIG. 1 of U.S. Pat. No. 4,452,882 using a bright room printer "P-627 FM" manufactured by Dainippon Screen Mfg. Co., Ltd., developed with Developing Solution A having the formulation shown below at 38° C. for 20 seconds in an automatic developing machine "FG 710 NH" manufactured by Fuji Photo Film Co., Ltd., fixed with a fixing solution "GR-F 1" produced by Fuji Photo Film Co., Ltd., washed with water, and dried.

| Formulation of Developing Solution A: | |
|---|---|
| Hydroquinone | 50.0 g |
| N-Methyl-p-aminophenol | 0.3 g |
| Sodium hydroxide | 18.0 g |
| Potassium hydroxide | 55.0 g |

-continued

| | |
|---|---|
| Formulation of Developing Solution A: | |
| 5-Sulfosalicylic acid | 45.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| N-n-Butyldiethanolamine | 15.0 g |
| Sodium toluenesulfonate | 8.0 g |
| Water to make | 1 l |
| pH (adjusted with potassium hydroxide) = 11.6 | |

4) Evaluation of Photographic Properties

Super-imposed letter image quality and $D_{max}$ of each of the processes samples were evaluated as follows, and the results obtained are shown in Table 1.

The light-sensitive material for dot-to-dot work was exposed under proper conditions so that a dot area of 50% of the original might be reproduced on the light-sensitive material as a dot area of 50%. When letters having a line width of 30 μm could be reproduced as superimposed letters, the image quality was rated "5" (best quality). On the other hand, when only letters having a line width of 150 μm or more were reproduced, such image quality was rated "1" (worst quality). Image quality between "5" and "1" was dividedly rated "4", "3", and "2" by visual observation Image quality levels rated "3" or higher are acceptable for practical use.

$D_{max}$ is a maximum density of the sample exposed in the same manner as described above.

It can be seen from the results shown in Table 1 that the samples according to the present invention exhibit high $D_{max}$ and excellent quality in transparent line image portions of dot image.

TABLE 1

| Sample No. | Hydrazine Compound Kind | Hydrazine Compound Amount (mol/mol-Ag) | $D_{max}$ | Transparent Line Image Quality | Remark |
|---|---|---|---|---|---|
| 1-a | Compound A | $2.0 \times 10^{-3}$ | 2.8 | 2 | Comparison |
| 1-b | Compound B | " | 3.0 | 3 | " |
| 1-c | Compound C | " | 2.5 | 2 | " |
| 1-1 | Compound 2 | " | 3.5 | 4 | Invention |
| 1-2 | Compound 5 | " | 3.9 | 5 | " |
| 1-3 | Compound 7 | " | 4.3 | 5 | " |
| 1-4 | Compound 11 | " | 4.0 | 5 | " |
| 1-5 | Compound 15 | " | 3.7 | 4 | " |

Compound A

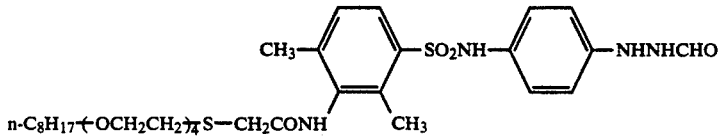

(Compound I-6 of U.S. Pat. No. 4,988,604)

Compound B

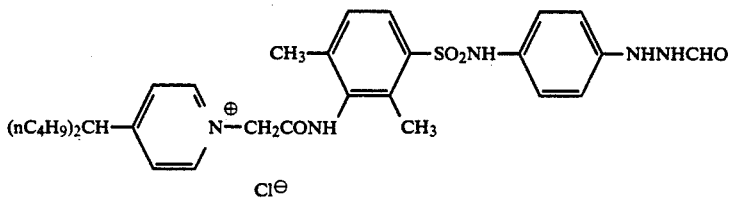

(Compound I-6 of U.S. Pat. No. 4,994,365)

Compound C

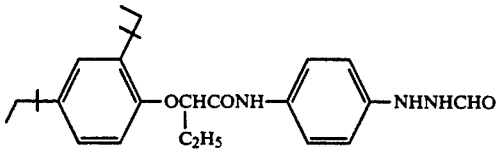

EXAMPLE 2

1) Preparation of Light-Sensitive Emulsion

A 0.13 M silver nitrate aqueous solution and a mixed aqueous solution containing 0.04 M potassium bromide, 0.09 M sodium chloride, and $1\times10^{-7}$ mol/mol-Ag of $(NH_4)_3RhCl_6$ were added to a gelatin aqueous solution containing 1,3-dimethyl-2-imidazolidinethione at 38° C. for 12 minutes while stirring according to a double jet process to conduct nucleation to form silver chlorobromide grains having a mean grain size of 0.15 μm and a silver chloride content of 70 mol %. Subsequently, a 0.87 M silver nitrate aqueous solution and a mixed aqueous solution containing 0.26 M potassium bromide and 0.65 M sodium chloride were added thereto over a period of 20 minutes according to a double jet process.

An aqueous solution containing $1\times10^{-3}$ mol of potassium iodide was added thereto to conduct conversion. After the emulsion was desalted by a flocculation method, 40 g of gelatin was added thereto. After adjusting to a pH of 6.5 and a pAg of 7.5, 5 mg of sodium thiosulfate and 8 mg of chloroauric acid each per mol of silver were added, followed by heating at 60° C. for 60 minutes to conduct chemical sensitization. To the sensitized emulsion was added 150 mg of 4-hydroxy-6-methyl-1,3,3a,7-tetraazaindene as a stabilizer. There was thus obtained an emulsion of silver chlorobromide cubic grains having a mean grain size of 0.27 μm (coefficient of variation: 10%) and a silver chloride content of 70 mol %.

2) Preparation of Sample

The above prepared emulsion was re-melted, and each of the hydrazine compounds shown in Table 2 below was added thereto. Further, $3.4\times10^{-4}$ mol/mol-Ag of compound S shown below, $2\times10^{-4}$ mol/mol-Ag of 1-phenyl-5-mercaptotetrazole, $5\times10^{-4}$ mol/mol-Ag of short wavelength cyanine dye (a) shown below, 200 mg/m² of water-soluble latex (b) shown below, 200 mg/m² of a polyethyl acrylate dispersion, and 200 mg/m² of 1,3-divinylsulfonyl-2-propanol as a gelatin hardening agent were added to the emulsion. To the emulsion was furthermore added 20 mg/m² of an amine compound shown below to prepare a coating composition for a light-sensitive emulsion layer.

Compound S:

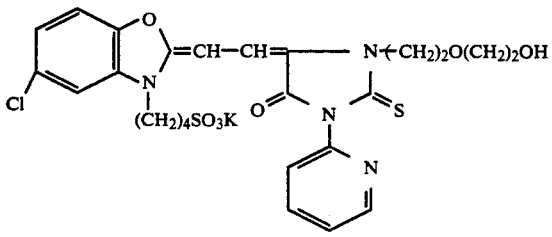

Compound (a):

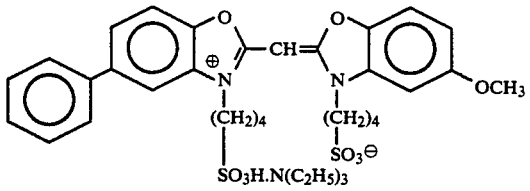

Compound (b):

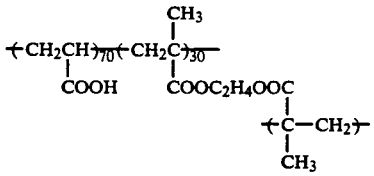

Amine Compound:

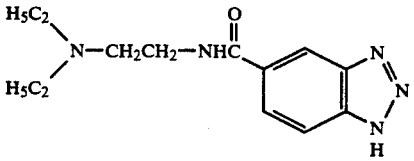

A coating composition for a protective layer was prepared from 1.0 g/m² of gelatin, 40 mg/m² of amorphous $SiO_2$ particles having an average particle size of about 3.5 μm as a matting agent, 0.1 g/m² of methanol silica, 100 mg/m² of polyacrylamide, 200 mg/m² of hydroquinone, silicone oil, and, as surface active agents, sodium dodecylbenzenesulfonate and a fluorine-containing compound of formula:

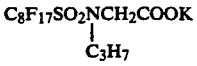

The above prepared coating compositions for a light-sensitive emulsion layer and a protective layer were simultaneously coated on a support film.

On the back side of the coated film were provided a backing layer and a back protective layer each having the following formulation:

Formulation of Backing Layer:

| | |
|---|---|
| Gelatin | 3 g/m² |
| Polyethyl acrylate latex | 2 g/m² |
| Sodium p-dodecylbenzenesulfonate | 40 mg/m² |
| Gelatin hardening agent of formula: | |

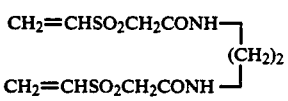

110 mg/m²

Fluorine-containing surface active agent of formula:

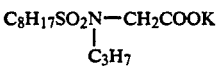

5 mg/m²

Dyes:

(a)

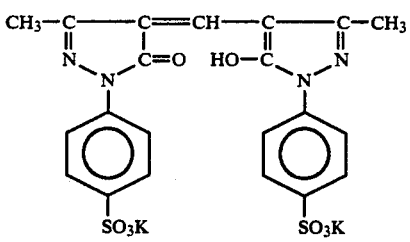

50 mg/m²

(b)

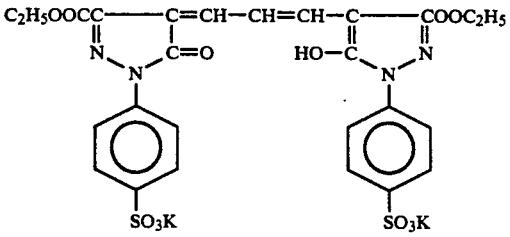

100 mg/m²

(c)

50 mg/m²

-continued

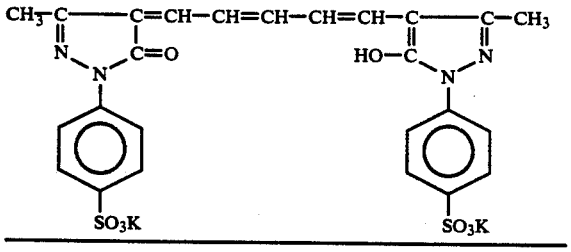

Formulation of Back Protective Layer

| | |
|---|---|
| Gelatin | 0.8 mg/m$^2$ |
| Polymethyl methacrylate particles (average particle size: 4.5 μm) | 30 mg/m$^2$ |
| Sodium dihexyl-α-sulfosuccinate | 15 mg/m$^2$ |
| Sodium dodecylbenzenesulfonate | 15 mg/m$^2$ |
| Sodium acetate | 40 mg/m$^2$ |

4) Processing

Each of the resulting samples was exposed to tungsten light of 3200° K. through an optical wedge and a contact screen ("150L Chain Dot Type" produced by Fuji Photo Film Co., Ltd.), developed with Developing Solution B having the following formulation at 34° C. for 30 seconds, fixed with "GR-F 1[, washed, and dried.

Formulation of Developing Solution B:

| | |
|---|---|
| Hydroquinone | 30.0 g |
| N-Methyl-p-aminophenol | 0.3 g |
| Sodium hydroxide | 10.0 g |
| Potassium sulfite | 60.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| Sodium toluenesulfonate | 8.0 g |
| Water to make | 1 l |
| pH | adjusted to 10.6 |

5) Evaluation of Photographic Properties:

Each of the processed samples was evaluated as follows. The results obtained are shown in Table 2.

Dot quality was visually evaluated and rated "5" (best quality), "4" (acceptable for practical use), "3" (lowest limit for practical use), "2" (unacceptable for practical use), or "1" (worst quality).

$D_{max}$ is an optical density at an exposure amount (0.5+log $E_3$) through optical wedge, which is larger than the exposure amount providing a density of 1.5 (log $E_3$) by 0.5.

It is seen from Table 2 that the light-sensitive materials containing the hydrazine compound according to the present invention exhibit high dot quality while retaining a high $D_{max}$ even when developed with a developing solution at a pH as low as 10.6. To the contrary, the comparative samples containing a conventional hydrazine compound did not provide sufficient dot quality when processed with the same developing solution.

TABLE 2

| Sample No. | Hydrazine Compound Kind | Amount (mol/mol-Ag) | $D_{max}$ | Dot Image Quality | Remark |
|---|---|---|---|---|---|
| 2-a | Compound A | $1.0 \times 10^{-3}$ | 3.5 | 2 | Comparison |
| 2-b | Compound B | " | 3.9 | 3 | " |
| 2-c | Compound C | " | 3.3 | 2 | " |
| 2-1 | Compound 2 | " | 4.1 | 4 | Invention |
| 2-2 | Compound 5 | " | 4.2 | 4 | " |
| 2-3 | Compound 7 | " | 4.6 | 5 | " |
| 2-4 | Compound 8 | " | 5.0 | 5 | " |
| 2-5 | Compound 11 | " | 4.5 | 5 | " |
| 2-6 | Compound 12 | " | 4.8 | 5 | " |
| 2-7 | Compound 17 | " | 5.3 | 5 | " |

EXAMPLE 3

Samples 3-1 to 3-5 and Comparison Samples 3-a to 3-c were prepared in the same manner as disclosed in Example 1 except that hydrazine compound (II) and comparative hydrazine compounds shown in Table 3 were used in an amount shown in Table 3, respectively.

The Samples and Comparison Samples, thus prepared, were processed, developed and evaluated in the same manner as stated in Example 1.

The results are shown in Table 3. It can be seen from the results shown in Table 3 that the samples according to the present invention exhibit high $D_{max}$ and excellent quality in transparent line image portions of dot image.

TABLE 3

| Sample No. | Hydrazine Compound Kind | Amount (mol/mol-Ag) | $D_{max}$ | Transparent Line Image Quality | Remark |
|---|---|---|---|---|---|
| 3-a | Compound A | $2.0 \times 10^{-3}$ | 2.8 | 2 | Comparison |
| 3-b | Compound B | " | 3.0 | 3 | " |
| 3-c | Compound C | " | 2.5 | 2 | " |
| 3-1 | Compound 22 | " | 3.3 | 4 | Invention |
| 3-2 | Compound 24 | " | 3.4 | 4 | " |
| 3-3 | Compound 26 | " | 3.7 | 4 | " |
| 3-4 | Compound 28 | " | 4.1 | 5 | " |
| 3-5 | Compound 29 | " | 3.9 | 4 | " |

EXAMPLE 4

Samples 4-1 to 4-7 and Comparison Samples 4-a to 4-c were prepared in the same manner as disclosed in Example 2, except that hydrazine compounds (II) and comparative hydrazine compounds shown in Table 4 were used in an amount shown in Table 4, respectively.

The Samples and Comparison Samples, thus prepared, were processed, developed and evaluated in the same manner as stated in Example 2.

The results are shown in Table 4. It can be seen from the results shown in Table 4 that the samples according to the present invention exhibit high dot quality while retaining a high $D_{max}$ even when developed with a developing solution at a pH as low as 10.6. To the contrary, the comparative samples containing a conventional hydrazine compound did not provide sufficient dot quality when processed with the same developing solution.

TABLE 4

| Sample No. | Hydrazine Compound Kind | Amount (mol/mol-Ag) | $D_{max}$ | Dot Image Quality | Remark |
|---|---|---|---|---|---|
| 4-a | Compound A | $1.0 \times 10^{-3}$ | 3.5 | 2 | Comparison |
| 4-b | Compound B | " | 3.9 | 3 | " |
| 4-c | Compound C | " | 3.3 | 2 | " |
| 4-1 | Compound 22 | " | 4.2 | 4 | Invention |
| 4-2 | Compound 24 | " | 4.3 | 4 | " |
| 4-3 | Compound 26 | " | 4.5 | 4 | " |
| 4-4 | Compound 28 | " | 4.9 | 5 | " |
| 4-5 | Compound 29 | " | 4.6 | 5 | " |
| 4-6 | Compound 30 | " | 4.8 | 5 | " |
| 4-7 | Compound 31 | " | 4.6 | 5 | " |

While the invention has been described in detail and with reference to specific examples thereof, it will be apparent to one skilled in the art that various changes and modifications can be made therein without departing from the spirit and scope thereof.

What is claimed is:

1. A silver halide light-sensitive material comprising a support having thereon a silver halide emulsion layer and a compound selected from compounds represented by formula (I) or (II):

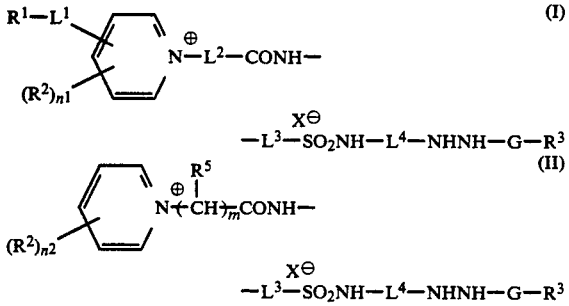

(I)

(II)

wherein $L^1$ represents —O—, —S—, —SO—, —$SO_2$—, —N($R^4$)—, —CONR$^4$—, —NR$^4$CO—, 'OCONR$^4$—, —NR$^4$CONR$^4$—, —$SO_2$NR$^4$—, NR$^4$$SO_2$— or —NR$^4$$SO_2$NR$^4$—, each of which is bonded to the pyridine ring at the right hand side thereof; $L^2$, $L^3$, and $L^4$ each represent a divalent aliphatic group or a divalent aromatic group; G represents —CO—, —$SO_2$—, —SO—, —COCO—, a thiocarbonyl group, an iminomethylene group or —P(O)(G$^1$R$^4$)—; G$^1$ represents a single bond, —O— or —NR$^4$—; $R^1$ represents an aliphatic group or an aromatic group; $R^2$ represents a monovalent substituent; $n^1$ represents 0 or an integer of from 1 to 4; $R^3$ represents a hydrogen atom, an aliphatic group, an aromatic group, an alkoxy group, an aryloxy group or an amino group; $R^4$ represents a hydrogen atom, an aliphatic group or an aromatic group; $R^5$ represents a monovalent group; m represents 0 or an integer of from 1 to 4; $n^2$ represents 0 or an integer of from 1 to 5; and $X^-$ represents a counter anion or a counter anion moiety in an intramolecular salt; two or more $R^2$'s, $R^4$'s or $R^5$'s, if any, may be the same or different.

2. A silver halide light-sensitive material as claimed in claim 1, wherein $R^1$ represents substituted or unsubstituted alkyl group having 1 to 30 carbon atoms; $R^2$ represents an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl or arylthio group, an alkyl or arylsulfonyl group, an alkyl or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group or an imido group;

$R^3$ represents an alkyl group having 1 to 4 carbon atoms, a monocyclic or bicyclic aryl group.

3. A silver halide light-sensitive material as claimed in claim 1, wherein, when G in formula (I) or (II) is —CO—, $R^3$ represents a hydrogen atom, an alkyl group, an aralkyl group, or an aryl group.

4. A silver halide light-sensitive material as claimed in claim 1, wherein $L^1$ in formula (I) represents —O—, —S—, —N($R^4$)—, —CONR$^4$—, —OCONR$^4$— or $SO_2$NR$^4$—, wherein $R^4$ is defined as in claim 1.

5. A silver halide light-sensitive material as claimed in claim 1, wherein $L^2$, $L^3$ and $L^4$ each represents a monocyclic or bicyclic aryl group or an unsaturated aromatic heterocyclic group which may be condensed with an aryl group.

6. A silver halide light-sensitive material as claimed in claim 1, wherein $R^5$ in formula (II) represents an alkyl group, an aralkyl group, an alkenyl group, an alkynyl group, an alkoxy group, a urethane group, an aryloxy group, a sulfamoyl group, a carbamoyl group, an alkyl or arylthio group, an alkyl or arylsulfonyl group, an alkyl or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group, or an imido group.

7. A silver halide light-sensitive material as claimed in claim 1, wherein the compound of formula (I) or (II) is used in an amount of $1.0 \times 10^{-6}$ to $5.10^{-2}$ mol per mole of a silver halide.

8. A silver halide light-sensitive material as claimed in claim 1, wherein, when G in formula (I) or (II) is —CO—, $R^3$ represents a hydrogen atom.

9. A silver halide light-sensitive material as claimed in claim 1, wherein, when G in formula (I) or (II) is —CO—, $R^3$ represents a methyl, trifluoromethyl, 3-hydroxypropyl, 3-methanesulfonamidopropyl, phenylsulfonylmethy, o-hydroxybenzyl, phenyl, 3,5-dichlorophenyl, o-methanesulfonamidophenyl, 4-methanesulfonylphenyl or 2-hydroxymethylphneyl group.

10. A silver halide light-sensitive material as claimed in claim 1, wherein the compound is represented by formula (II) and $R^5$ in formula (II) represents an alkyl group having 1 to 20 carbon atoms.

11. A silver halide light-sensitive material as claimed in claim 1, wherein the compound is represented by formula (II) and $R^5$ in formula (II) represents an aralkyl group having 7 to 30 carbon atoms.

12. A silver halide light-sensitive material as claimed in claim 1, wherein the compound is represented by formula (II) and $R^5$ in formula (II) represents an alkoxy group having 1 to 20 carbon atoms.

13. A silver halide light-sensitive material as claimed in claim 1, wherein the compound is represented by formula (II) and $R^5$ in formula (II) represents an amino group substituted with an alkyl group having 1 to 20 carbon atoms.

14. A silver halide light-sensitive material as claimed in claim 1, wherein the compound is represented by formula (I).

15. A silver halide light-sensitive material as claimed in claim 1, wherein the compound is represented by formula (II).

* * * * *